US008979502B2

(12) United States Patent
Paquet et al.

(10) Patent No.: US 8,979,502 B2
(45) Date of Patent: Mar. 17, 2015

(54) TURBINE ROTOR RETAINING SYSTEM

(75) Inventors: René Paquet, Montreal (CA); David Glasspoole, St. Lambert (CA)

(73) Assignee: Pratt & Whitney Canada Corp., Longueuil, Quebec (CA)

( * ) Notice: Subject to any disclaimer, the term of this patent is extended or adjusted under 35 U.S.C. 154(b) by 727 days.

(21) Appl. No.: 13/326,518

(22) Filed: Dec. 15, 2011

(65) Prior Publication Data

US 2013/0156589 A1 Jun. 20, 2013

(51) Int. Cl.
*F01D 5/00* (2006.01)
*F01D 25/00* (2006.01)

(52) U.S. Cl.
USPC ..... 416/244 A

(58) Field of Classification Search
CPC ..... F01D 5/025; F01D 5/02; F04D 29/266; F04D 25/088; F04D 29/601
USPC ..... 416/244 R, 244 A, 204 R, 204 A; 415/216.1; 403/315, 316; 464/182
See application file for complete search history.

(56) References Cited

U.S. PATENT DOCUMENTS 3,395,891 A 8/1968 Burge et al.
3,666,376 A 5/1972 Damlis
3,722,058 A * 3/1973 Corsmeier ..... 29/270
3,807,898 A * 4/1974 Guy et al. ..... 416/220 R
3,936,234 A 2/1976 Tucker et al.
4,037,990 A 7/1977 Harris
4,102,603 A 7/1978 Smith et al.
4,108,571 A 8/1978 Mawson
4,304,523 A 12/1981 Corsmeier et al.
4,349,318 A * 9/1982 Libertini et al. ..... 416/220 R
4,456,425 A * 6/1984 McCarty et al. ..... 415/122.1
4,470,757 A 9/1984 Vollinger
4,483,661 A 11/1984 Manharth et al.
4,505,640 A 3/1985 Hsing et al.
4,778,342 A 10/1988 Conlow
4,797,065 A 1/1989 Conlow
5,123,813 A 6/1992 Przytulski et al.
5,256,035 A * 10/1993 Norris et al. ..... 416/220 R
5,288,210 A * 2/1994 Albrecht et al. ..... 416/198 A
5,302,086 A * 4/1994 Kulesa et al. ..... 416/221
5,993,160 A 11/1999 Bouchard et al.
6,234,756 B1 5/2001 Ress, Jr. et al.
6,398,500 B2 6/2002 Pedersen et al.
6,520,743 B2 2/2003 Arilla et al.
7,040,866 B2 5/2006 Gagner
7,530,791 B2 5/2009 Douville et al.
8,186,939 B2 * 5/2012 Lecuyer et al. ..... 415/115
8,348,620 B2 * 1/2013 Dejaune et al. ..... 416/220 R
8,517,687 B2 * 8/2013 Benjamin et al. ..... 416/198 A
2009/0053065 A1 2/2009 Oka

* cited by examiner

*Primary Examiner* — Edward Look
*Assistant Examiner* — Christopher J Hargitt
(74) *Attorney, Agent, or Firm* — Norton Rose Fulbright Canada LLP

(57) ABSTRACT

A rotor retaining system for a rotor assembly of a gas turbine engine includes a washer interlocking multiple retaining nuts to prevent relative rotation. The retaining nuts retain a rotor disc and a cover plate in position, respectively. A wire is provided to retain the washer in position and which may dampen vibration during engine operation.

17 Claims, 4 Drawing Sheets

TURBINE ROTOR RETAINING SYSTEM

TECHNICAL FIELD

The described subject matter relates generally to gas turbine engines, and more particularly to a turbine rotor retaining system of a gas turbine engine.

BACKGROUND OF THE ART

A gas turbine engine rotor assembly conventionally comprises a plurality of circumferentially spaced airfoils which extend radially outwardly from a rotor disc. During engine operation the rotor assembly is rotated at a high speed, thereby creating a centrifugal force acting on engine components. Axial forces are imparted to the airfoils as fluid passes through the rotor assembly. The rotor assemblies often include a dovetail or firtree attachment mechanism for coupling the engine components together and for resisting the centrifugal force acting on the components. Axial retaining mechanisms such as rabbets, bolts, tangs, pins or split rings may also be provided to counteract axial loads on the airfoil. The high-speed rotation of the rotor assembly causes a centrifugal load associated with the retaining mechanisms, which may result in vibration. In order to reduce vibration, the retaining mechanisms often have to be balanced, which incurs additional time and costs.

Accordingly, there is a need to provide an improved rotor retaining system for a rotor assembly of a gas turbine engine.

SUMMARY

In one aspect, the described subject matter provides a rotor retaining system for a rotor assembly of a gas turbine engine, the rotor assembly including a shaft, a rotor disc mounted on the shaft, a plurality of blades extending radially from the rotor disc and a cover plate attached to a side of the rotor disc, the rotor retaining system comprising: a first retaining nut threadingly engaging the shaft and retaining the rotor disc in position on the shaft; a second retaining nut disposed around the first retaining nut, threadingly engaging the rotor disc and retaining the cover plate in position relative to the rotor disc; a washer engaging both the first and second retaining nuts to interlock one retaining nut relative to another to impede relative rotation between first and second retaining nuts; and a wire removably engaging one of the first and second retaining nuts and disposed axially adjacent to the washer to retain the washer in position.

In another aspect, the described subject matter provides a rotor assembly of a gas turbine engine comprising: a shaft; a rotor disc mounted on the shaft and retained in position by a first retaining nut which threadingly engages the shaft in a first rotational direction; a plurality of blades received in circumferentially spaced slots in the rotor disc and axially extending across the rotor disc; a cover plate attached to the rotor disc and retaining the blades in the respective slots of the rotor disc, the cover plate being retained in position relative to the rotor disc, by a second retaining nut which threadingly engages the rotor disc in a second rotational direction opposite to the first rotational direction; a washer positioned adjacent the first and second retaining nuts to impede relative rotation between the first and second retaining nuts; and a wire removably engaging one of the first and second retaining nuts and disposed axially adjacent to the washer to retain the washer in position.

In a further aspect, the described subject matter provides a method for retaining components of a rotor assembly of a gas turbine engine, the method comprising: a) providing a first retaining nut threadingly engaging the rotor assembly in a first rotational direction for retaining a first one of the components in position; b) providing a second retaining nut threadingly engaging the rotor assembly in a second rotational direction opposite the first rotational direction, for retaining a second one of the components in position; c) using a washer to interlock the first and second retaining nuts one relative to another to impede relative rotation between the first and second retaining nuts; and d) engaging a wire to one of the first and second retaining nuts for retaining the washer in position.

Further details of these and other aspects of the described subject matter will be apparent from the detailed description and drawings included below.

BRIEF DESCRIPTION OF THE DRAWINGS

Reference is now made to the accompanying drawings depicting aspects of the described subject matter, in which.

It will be noted that throughout the appended drawings, like features are identified by like reference numerals.

DETAILED DESCRIPTION

Figure 1:
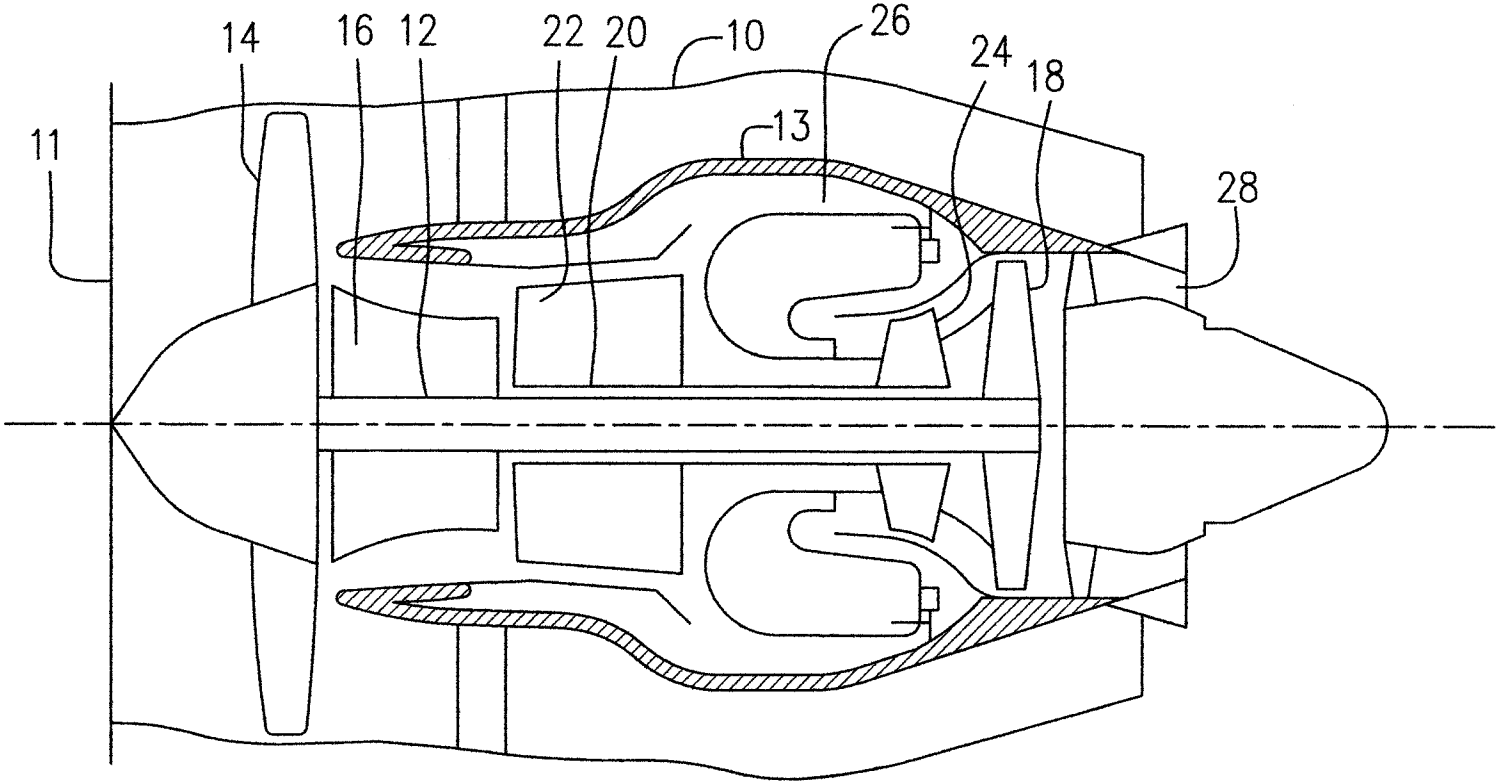
FIG. 1 is schematic cross-sectional view of a turbofan gas turbine engine illustrating an exemplary application of the described subject matter.

FIG. 1 illustrates a turbofan gas turbine aircraft engine presented as an example of the application of the described subject matter, including a housing or nacelle annular outer case 10, a annular core casing 13, a low pressure spool assembly (not numbered) which includes a fan assembly 14, a low pressure compressor assembly 16 and a low pressure turbine assembly 18, connected together by a shaft 12, and a high pressure spool assembly (not numbered) which includes a high pressure compressor assembly 22 and a high pressure turbine assembly 24, connected together by a hollow shaft 20 which is positioned coaxially around the shaft 12. The annular core casing 13 surrounds the low and high pressure spool assemblies in order to define a main fluid path (not numbered) therethrough. In the main fluid path there is provided a combustor to constitute a gas generator section 26.

It should be noted that the terms "radial", "axial" and "circumferential" used in the description below refer to orientation about an engine central axis (not numbered) as shown in FIG. 1. The terms "upstream" and "downstream" used in the description below generally refer to the direction of a gas flow from an engine inlet 11 to an engine outlet 28 as shown in FIG. 1. The terms "forward" and "rearward" used in the description below also generally refer to the direction toward the engine inlet 11 and the engine outlet 28, respectively.

Referring to FIGS. 1-6, a rotor assembly 30 in for example the high pressure compressor assembly 22 includes a rotor disc 32 mounted on the hollow shaft 20 to rotate together therewith. The rotor disc 32 is axially located immediately downstream of an impeller 34 of a centrifugal compressor which may also be part of the high pressure compressor assembly 22 and is mounted to the hollow shaft 20 to rotate together therewith. The rotor disc 32 is locked in an axial location on the shaft 20 by a retaining nut 36. The retaining nut 36 has an annular body (not numbered) with inner threads (not shown) which engage outer threads (not shown) on the shaft 20. Therefore, the retaining nut 36 can be rotated about the shaft 20 to axially move forward against a radial contact surface 38 of the rotor disc 32 in order to prevent the rotor disc 32 from rearward axial movement relative to the shaft 20.

The rotor assembly 30 includes a plurality of circumferentially spaced airfoil blades 40 which extend radially outwardly from the rotor disc 32, each having a root section (not numbered) received in respective slots 42 of the rotor disc 32. The slots 42 are circumferentially spaced one from another on an outer periphery (not numbered) of the rotor disc 32 and axially extend across the outer periphery. A cover plate 44 having an annular body (not numbered) which may be in a dish-like profile, is attached to a rear side of the rotor disc 32. The cover plate 44 has an annular large-diameter axial end 46 defined at one side of the cover plate 44 and an annular small-diameter axial end 48 at the other side of the cover plate 44. The annular large-diameter axial end 46 of the cover plate 44 is disposed against a radial surface (not numbered) of the outer periphery of the rotor disc 32 and partially covers each of the slots 42, to thereby prevent the blades 40 from rearward axial withdrawal from the respective slots 42. The cover plate 44 is in turn, retained in position relative to the rotor disc 32 by a retaining nut 50 which threadingly engages the rotor disc 32 at a rearward end portion which is formed by a cylindrical wall (not numbered) of the rotor disc 32. The cylindrical wall is positioned around and radially spaced apart from the retaining nut 36.

The retaining nut 50 includes an annular body (not numbered) having inner threads (not shown) for engagement with outer threads (not shown) on the rearward end portion of the rotor disc 32 such that the retaining nut 50 can be rotated to move forwardly on the rearward end portion of the rotor disc 32 against the annular small-diameter axial end 48 of the cover plate 44, thereby pushing the annular large-diameter axial end 46 of the cover plate 44 forward to be in tight contact with the radial surface of the outer periphery portion of the rotor disc 32.

Figure 5:
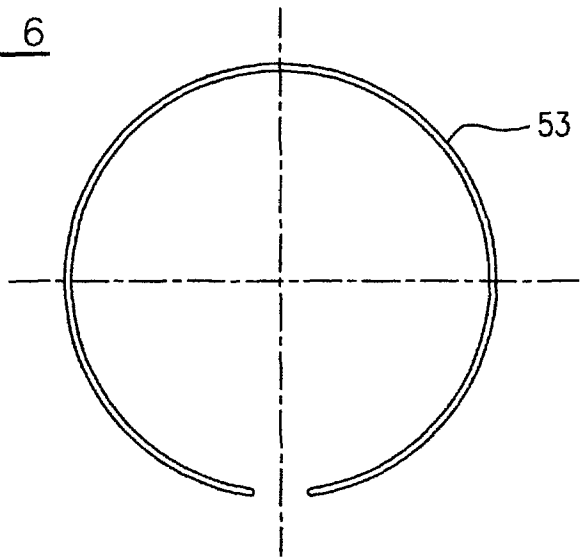
FIG. 5 is an front elevational view of a damper wire used in the rotor retaining system of FIG. 3.
Figure 6:
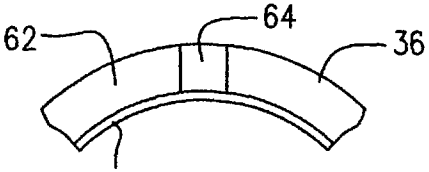
FIG. 6 is a partial rear elevational view of a first retaining nut, showing a recess in a slot configuration defined in an end section of the retaining nut.

A washer 52 is provided adjacent to and engaging both the retaining nuts 36 and 50, to interlock the retaining nuts 36 and 50 one to another, thereby preventing the respective retaining nuts 36 and 50 from rotation, which will be further described hereinafter. A damper wire 53 which is a single metal wire forming a split ring as shown in FIG. 5, removably engages for example with the retaining nut 50 for retaining the washer 52 in position and for damping vibration of the rotor assembly 30 during engine operation. Therefore, the damper wire may be selected to provide proper mass and resiliency such that the damper wire 53 is enabled to damp vibration when the damper wire 53 is attached to the rotor assembly 30.

Figure 2:
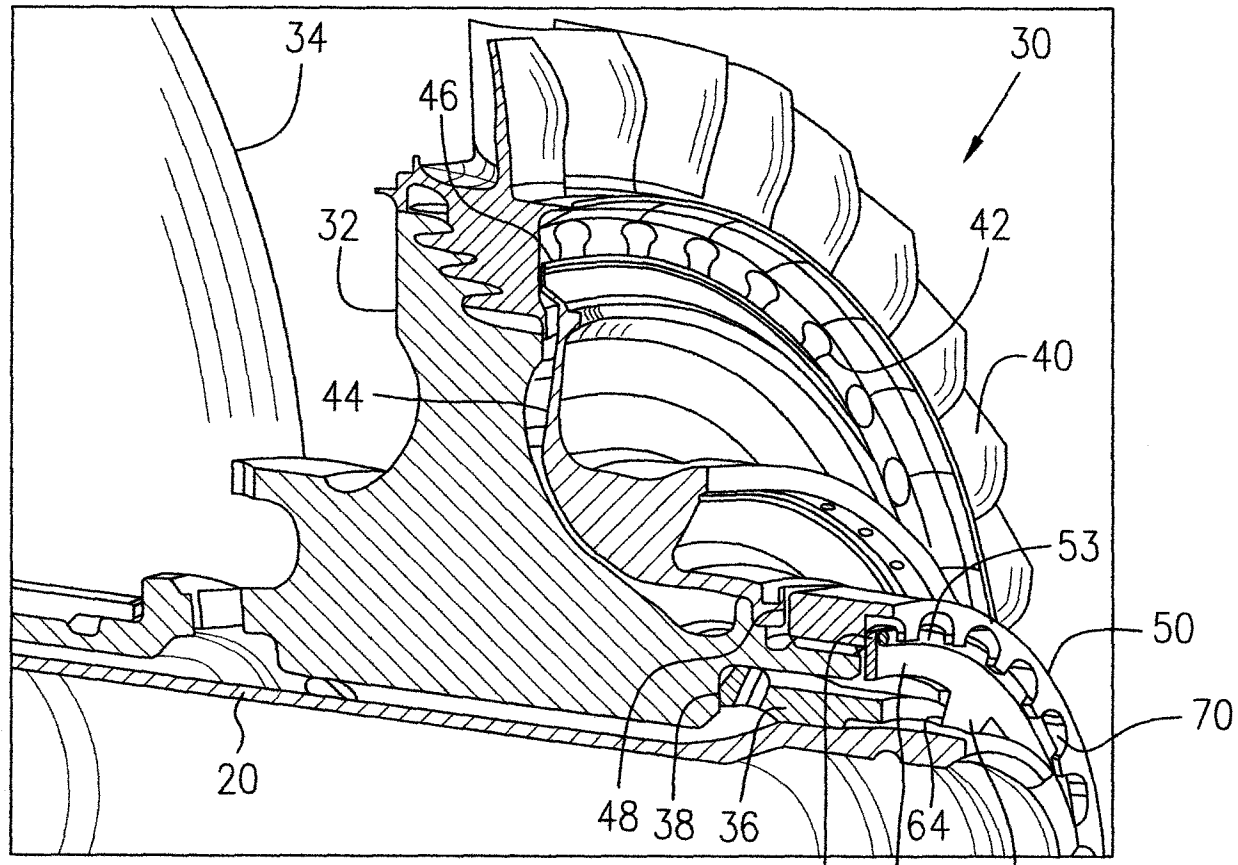
FIG. 2 is a partial perspective view of a compressor assembly of the turbofan gas turbine engine of FIG. 1, with a front portion thereof cut away to show internal structures of the assembly.
Figure 3:
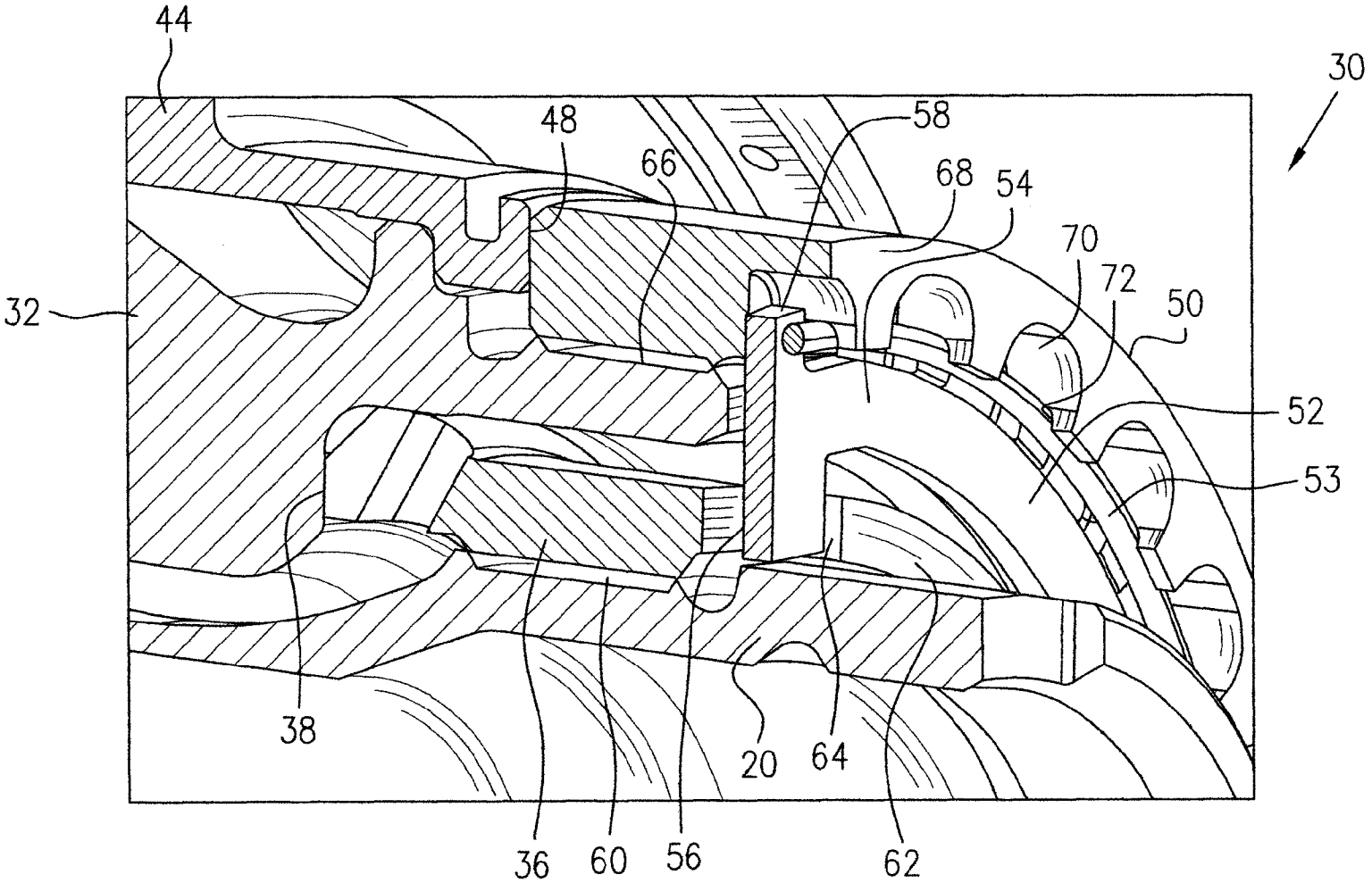
FIG. 3 is a partial enlarged view of the compressor assembly illustrated in in FIG. 2, showing the details of a rotor retaining system for the rotor assembly.
Figure 4:
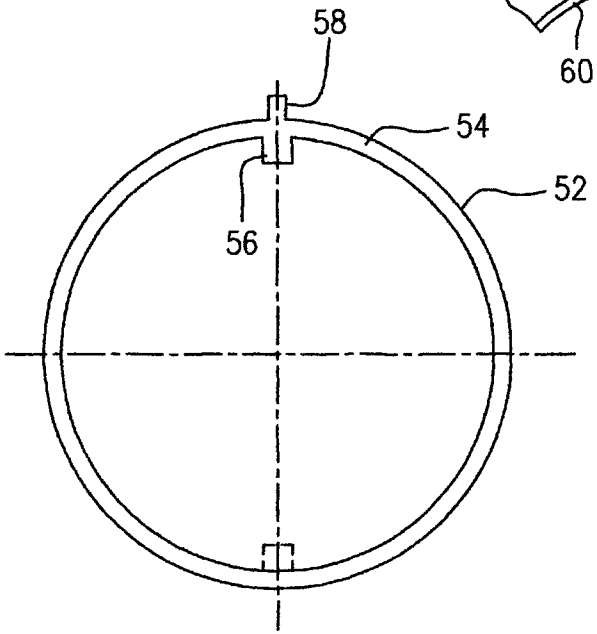
FIG. 4 is an front elevational view of a washer used in the rotor retaining system of FIG. 3.

In one embodiment, the washer 52 may be formed with a metal ring having for example, opposed radial surfaces 54 (only one shown). The washer 52 may have a first lock member 56 integrated with the metal ring of the washer 52 and extending radially inwardly from the metal ring. The washer 52 may further include a second lock member 58 integrated with the metal ring and extending radially outwardly from the metal ring of the washer 52. The first and second lock members 56, 58 may be circumferentially aligned one with another according to this embodiment, as shown in FIGS. 3 and 4. Nevertheless, the first and second lock members 56, 58 may be circumferentially spaced apart, according to another embodiment as shown in FIG. 2. Alternatively, the first lock member 56 may be disposed in a circumferential location as illustrated by the broken line in FIG. 4, to be diametrically opposite the second lock member 58, in consideration of weight balances of the washer 52.

According to one embodiment, the retaining nut 36 may have a threaded section 60 containing inner threads for threaded engagement with the shaft 20 and an annular end section 62 provided with at least one recess 64 having an opening on the radial surface of the annular end section 62. The recess 64 may be formed as a slot extending radially through the annular end section 62 for receiving the first lock member 56 of the washer 52. A second recess (not shown) similar to the recess 64, may be provided in the annular end section 62 of the retaining nut 36, diametrically opposite the recess 64 in consideration of weight balance of the retaining nut 36.

According to one embodiment, the retaining nut 50 may also include an annular end section 68 and a threaded section 66 containing inner threads for threaded engagement with the annular rearward end portion of the rotor disc 32. The annular end section 68 may be provided with a plurality of recesses 70, for example, circumferentially spaced apart one from another. The recesses 70 have an opening on the radial annular surface of the annular end section 68 of the retaining nut 50. The recesses 70 each may extend radially outwardly from an annular inner surface (not numbered) of the annular end section 68 of the retaining nut 50 such that the second lock member 58 may be selectively received in one of the recesses 70. The retaining nut 50 may further include a circumferential annular groove 72 extending radially outwardly from the annular inner surface of the annular end section 68 of the retaining nut 50. The circumferential annular groove 72 may circumferentially extend through the respective recesses 70, and may also be more shallow than the recesses 70. Therefore, the circumferential groove 72 may be segregated by the respective recesses 70 into separate circumferential groove sections, each section being positioned between adjacent recesses 70. The damper wire 53 may be received in the circumferential groove 72 or in the circumferential groove sections thereof, as shown in FIG. 3.

When both retaining nuts 36 and 50 are tightened in position to retain the rotor disc 32 and the cover plate 44 in their respective positions, the washer 52 is positioned radially between the annular end section 62 of the retaining nut 36 and the annular end section 68 of the retaining nut 50. The retaining nuts 36 and 50 are tightened such that one of the recesses 70 of the retaining nut 50 circumferentially aligns with the recess 64 of the retaining nut 36. Therefore, the first and second lock members 56, 58 can be axially moved into and received in the respective aligned recesses 64, 70 in the respective retaining nuts 36 and 50. The threaded engagement between the retaining nut 36 and the shaft 20 is in a rotational direction opposite to the rotational direction of the threaded engagement between the retaining nut 50 and the annular end portion of the rotor disc 32. When one of the retaining nuts 36 and 50 is rotated in a direction to loosen the threaded engagement, the other of the retaining nuts 36 and 50 is to rotated in the same direction, which further tightens the threaded engagement of said other one of the retaining nuts 36, 50, because the two retaining nuts 36 and 50 are interlocked together by the washer 52. Therefore, the retaining nuts 36 and 50 prevent each other from rotation while the washer 52 is in position. The washer 52 in turn is axially restrained between a radial surface (not numbered) of the selected radial recess 70 of the retaining nut 50 and the damper wire 53 which is fittingly received in the annular groove 72 in the retaining nut 50.

In the embodiment wherein the first and second lock members 56, 58 are not circumferentially aligned with each other as shown in FIG. 2, the retaining nuts 36 and 50 are tightened such that a selected one of the recesses 70 aligns with the second lock member 58 of the washer 52 when the first lock member 56 aligns with the recess 64 in the retaining nut 36. Therefore, in all embodiments the washer 52 can be axially moved into position and interlocks the retaining nuts 36 and 50 one to another, to prevent relative rotation therebetween.

According to one embodiment, the retaining nuts 36 and 50 of the rotor assembly 30 are prevented from rotation by only one washer 52 with the damper wire 53. The lock members 56 and 58 of the washer 52 can be conveniently placed in the recess 64 of the retaining nut 36 and a selective one of the recesses 70 of the retaining nut 50 respectively, when the washer 52 is axially forwardly moved into an annulus (not numbered) between the end sections 62 and 68 of the respective retaining nuts 36, 50. There is no need for a crimp action which is conventionally required to crimp tabs of a washer for locking a nut. In contrast to a conventional retaining ring, the mass/weight of the damper wire 53 is relatively small and an imbalance effect which could be caused by the damper wire 53 may be small enough to be ignored, and therefore no balancing action is required. The damper wire 53 is spring loaded within the annular groove 72 in the retaining nut 50 and therefore does not require a catcher feature. The spring loaded damper wire 53 performs not only as a lock ring but also as a damper to absorb vibration energy of the rotor assembly 30.

The above description is meant to be exemplary only, and one skilled in the art will recognize that changes may be made to the embodiments described without departure from the scope of the described subject matter. For example, a turbofan gas turbine engine has been described as an exemplary application of the subject matter, however, it should be understood that gas turbine engines of various types may also be applicable for the described subject matter. The rotor retaining system as described in the above-noted embodiment is for a high pressure rotor assembly of a gas turbine engine, however the above-described rotor retaining system may also be applicable to other rotor assemblies of gas turbine engines, such as low pressure rotor assemblies, low or high pressure turbine assemblies, etc . . . The damper wire may be attached to either one of the retaining nuts. The plurality of recesses for selective engagement with a lock member of the washer may also be defined in either one of the retaining nuts. Still other modifications which fall within the scope of the described subject matter will be apparent to those skilled in the art, in light of a review of this disclosure, and such modifications are intended to fall within the appended claims.

The invention claimed is:

1. A rotor retaining system for a rotor assembly of a gas turbine engine, the rotor assembly including a shaft, a rotor disc mounted on the shaft, a plurality of blades extending radially from the rotor disc and a cover plate attached to a side of the rotor disc, the rotor retaining system comprising:

a first retaining nut threadingly engaging the shaft and retaining the rotor disc in position on the shaft;

a second retaining nut disposed around the first retaining nut, threadingly engaging the rotor disc and retaining the cover plate in position relative to the rotor disc;

a washer engaging both the first and second retaining nuts to interlock one retaining nut relative to another to impede relative rotation between first and second retaining nuts; and a wire removably engaging one of the first and second retaining nuts and disposed axially adjacent to the washer to retain the washer in position.

2. The rotor retaining system as defined in claim 1 wherein the wire comprises a single wire in a split ring configuration.

3. The rotor retaining system as defined in claim 1 wherein the wire is received in a circumferentially extending groove defined in the second retaining nut.

4. The rotor retaining system as defined in claim 1 wherein the washer comprises a ring disposed radially between the first and second retaining nuts, a first lock member extending radially inwardly from the ring into a recess in the first retaining nut and a second lock member extending radially outwardly from the ring into a recess in the second retaining nut.

5. The rotor retaining system as defined in claim 4 wherein each of the recesses defines an opening on an axial end of the respective first and second retaining nuts for axial access to the recesses.

6. The rotor retaining system as defined in claim 5 wherein the second lock member of the washer is restrained axially between a radial surface of the radial recess of the second retaining nut and the wire.

7. The rotor retaining system as defined in claim 1 wherein one of the first and second retaining nuts comprises a plurality of circumferentially spaced radial recesses for selectively receiving a corresponding one of the first and second lock members of the washer.

8. The rotor retaining system as defined in claim 1 wherein the second retaining nut comprises a plurality of circumferentially spaced radial recesses for selectively receiving the second lock member of the washer.

9. The rotor retaining system as defined in claim 1 wherein a thread direction of the threaded engagement between the second retaining nut and the cover plate is opposite to a thread direction of the threaded engagement between the first retaining nut and the shaft.

10. A rotor assembly of a gas turbine engine comprising:

a shaft;

a rotor disc mounted on the shaft and retained in position by a first retaining nut which threadingly engages the shaft in a first rotational direction;

a plurality of blades received in circumferentially spaced slots in the rotor disc and axially extending across the rotor disc;

a cover plate attached to the rotor disc and retaining the blades in the respective slots of the rotor disc, the cover plate being retained in position relative to the rotor disc, by a second retaining nut which threadingly engages the rotor disc in a second rotational direction opposite to the first rotational direction;

a washer positioned adjacent the first and second retaining nuts to impede relative rotation between the first and second retaining nuts; and a wire removably engaging one of the first and second retaining nuts and disposed axially adjacent to the washer to retain the washer in position.

11. The rotor assembly as defined in claim 10 wherein each of the first and second retaining nuts comprises a threaded section and an end section, the end sections defining at least one recess, the washer having first and second lock members received in the respective recesses to thereby prevent the respective retaining nuts from rotation relative to each other.

12. The rotor assembly as defined in claim 11 wherein the second retaining nut comprises a plurality of recesses including said at least one recess, for selectively receiving the second lock member of the washer.

13. The rotor assembly as defined in claim 11 wherein the wire comprises a split ring configuration received in a circumferential groove in the end section of the second retaining nut, the split ring configuration abutting the second lock member of the washer against a radial surface of the recess receiving the second lock member.

14. The rotor assembly as defined in claim 11 wherein the rotor disc comprises a cylindrical wall forming a rearward end portion of the rotor disc, the cylindrical wall extending around and radially spaced apart from the first retaining nut, the second retaining nut engaging a threaded outer surface of the cylindrical wall.

15. The rotor assembly as defined in claim 11 wherein the washer comprises a flat ring, the first lock member extending radially inwardly from the flat ring and the second lock member extending radially and outwardly from the flat ring.

16. A method for retaining components of a rotor assembly of a gas turbine engine, the method comprising:

a) providing a first retaining nut threadingly engaging the rotor assembly in a first rotational direction for retaining a first one of the components in position;

b) providing a second retaining nut threadingly engaging the rotor assembly in a second rotational direction opposite the first rotational direction, for retaining a second one of the components in position;

c) using a washer to interlock the first and second retaining nuts one relative to another to impede relative rotation between the first and second retaining nuts; and d) engaging a wire to one of the first and second retaining nuts for retaining the washer in position.

17. The method as defined in claim 16 further comprising a step of selecting a type of wire to be used in step (d) for damping vibration of the rotor assembly during engine operation.

* * * * *